US008796577B2

(12) United States Patent
Harres et al.

(10) Patent No.: US 8,796,577 B2
(45) Date of Patent: Aug. 5, 2014

(54) MULTI-MACHINE MAIL SORTING SYSTEM

(75) Inventors: Luiz C. Harres, Allen, TX (US); Peter Berdelle-Hilge, Constance (DE); Homer Dickerson, Ft. Worth, TX (US); Lelan Warren, Dallas, TX (US); Tamas Eger, Arlington, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 604 days.

(21) Appl. No.: 12/271,458

(22) Filed: Nov. 14, 2008

(65) Prior Publication Data

US 2010/0122942 A1 May 20, 2010

(51) Int. Cl.
*G06K 9/00* (2006.01)

(52) U.S. Cl.
USPC ..... 209/584; 209/583; 209/900

(58) Field of Classification Search
USPC ..... 209/583, 584, 900; 700/223–227
See application file for complete search history.

(56) References Cited

U.S. PATENT DOCUMENTS

| | | | | |
|---|---|---|---|---|
| 5,014,329 | A | 5/1991 | Rudak | |
| 5,109,987 | A | 5/1992 | Daboub et al. | |
| 5,119,954 | A | 6/1992 | Svyatsky et al. | |
| 5,338,295 | A | 8/1994 | Cornelius et al. | |
| 5,422,821 | A | 6/1995 | Allen et al. | |
| 6,365,862 | B1 | 4/2002 | Miller et al. | |
| 6,612,572 | B1 * | 9/2003 | Mohr et al. | 271/280 |
| 6,671,577 | B2 | 12/2003 | Barnum et al. | |
| 6,793,136 | B2 | 9/2004 | Wells et al. | |
| 6,897,394 | B1 * | 5/2005 | Dibiaso et al. | 209/584 |
| 6,968,209 | B1 | 11/2005 | Ahlgren et al. | |
| 7,024,478 | B1 | 4/2006 | Dalgic et al. | |
| 7,090,134 | B2 | 8/2006 | Ramsager | |
| 7,259,346 | B2 | 8/2007 | Svyatsky et al. | |
| 7,767,925 | B2 * | 8/2010 | DiBiaso et al. | 209/584 |
| 2002/0104782 | A1 * | 8/2002 | DeWitt et al. | 209/3.3 |
| 2004/0200761 | A1 | 10/2004 | Hanson et al. | |
| 2005/0247606 | A1 * | 11/2005 | Redford et al. | 209/584 |
| 2008/0133049 | A1 * | 6/2008 | Barnum et al. | 700/224 |

* cited by examiner

*Primary Examiner* — Joseph C Rodriguez
*Assistant Examiner* — Kalyanavenkateshware Kumar

(57) ABSTRACT

A sorting system for postal mail has a plurality of input sections capable of operating in parallel, each including a feeder that takes in mail pieces one at a time and a scanner that scans each mail piece for destination indicia. The system further includes a plurality of stackers each comprising at least one row of pockets in which mail is stacked, and a routing section or switch network effective to route mail in accordance with a sort scheme from any input section to any pocket of a stacker. The routing section uses diverts and merges so that mail can be conveyed to each stacker in accordance with a sort scheme implemented by a control system.

11 Claims, 12 Drawing Sheets

MULTI-MACHINE MAIL SORTING SYSTEM

FIELD OF THE INVENTION

The invention relates to mail sorting machines and processes of the type currently carried out by the U.S. Postal Service (USPS).

BACKGROUND OF THE INVENTION

Barnum et al. U.S. Pat. No. 6,671,577, Dec. 30, 2003, describes a system and method for directly connecting an ISS advanced facer canceler system (IAFCS) to a DBCS/OSS. Limitations of this system are described in commonly assigned Redford et al. U.S. Patent Publication No. 20050247606, Nov. 10, 2005, the contents of which are incorporated by reference herein for all purposes. Redford et al. describes a sorting system using multiple sorters operating as part of a single, multi-sorting machine unified system. The '606 system includes a plurality of input sections capable of operating in parallel, each including a feeder that takes in mail pieces one at a time and a scanner that scans each mail piece for destination indicia, a plurality of stackers each comprising at least one row of pockets, a control system that determines a destination pocket in the stacker for each mail piece based on a predetermined sort scheme and the destination indicia, and a routing system effective to route mail in accordance with the sort scheme from any input section to any pocket of a stacker.

The routing section of the '606 publication relies in part on crossover sections where a mail piece being conveyed from one input section to a stacker crosses over (passes through) another conveyor. Such a crossover function increases the likelihood of contention between mail pieces at the intersection of the conveyor paths. The present invention seeks to increases performance in a multi-machine sorting system of the kind described in the '606 publication by reducing the quantity of mail that must be rejected due to situations in which mail needs to be sent simultaneously to the same path. This increases the effective overall throughput of the system is and reduces the amount of mail that must be fed again.

SUMMARY OF THE INVENTION

A sorting system for postal mail has a plurality of input sections capable of operating in parallel, each including a feeder that takes in mail pieces one at a time and a scanner that scans each mail piece for destination indicia. The system further includes a plurality of stackers each comprising at least one row of pockets in which mail is stacked, and a routing section or switch network effective to route mail in accordance with a sort scheme from any input section to any pocket of a stacker. The routing section uses diverts and merges so that mail can be conveyed to each stacker in accordance with a sort scheme implemented by a control system.

The present invention provides a sorting system using multiple sorters operating as part of a single, multi-sorting machine unified system capable of operating more rapidly than the system of Redford et al. U.S. Patent Publication No. 20050247606. A sorting system for postal mail according to the invention includes a plurality of input sections capable of operating in parallel, each including a feeder that takes in mail pieces one at a time and a scanner that scans each mail piece for destination indicia, a plurality of stackers each comprising at least one row of pockets in which mail is stacked, and a routing section effective to route mail in accordance with a sort scheme from any input section to any pocket of a stacker.

The routing section includes first conveyors which transport singulated incoming streams of mail pieces away from each of the input sections, a merge section which receives singulated incoming streams of mail from the first conveyors and merges mail pieces from such singulated incoming streams of mail into outgoing streams each containing mail pieces destined for one or more rows of stacker pockets as determined by the sort scheme. The merge section includes second conveyors which receive the incoming streams of mail pieces from the first conveyors, refeed chutes positioned in the second conveyors to receive mail pieces which must be removed from the merge section, first diverts positioned to selectively divert mail pieces to a second conveyor based on the sort scheme, second diverts positioned in the second conveyors to selectively divert mail pieces to a refeed chute of each second conveyor, merges positioned in the second conveyors to merge mail pieces into an outgoing stream on a second conveyor, and detectors which detect when a mail piece is in position to be diverted by a divert.

A set of third conveyors transport streams of outgoing mail pieces from the merge section to the rows of pockets of the stackers. A control system determines a destination pocket in the stacker for each mail piece based on the sort scheme and the destination indicia read by the scanners of the input sections, and operates the first diverts to create the outgoing streams of mail according to the sort scheme while operating the second diverts associated with refeed chutes when the control system determines that a mail piece entering a merge cannot be merged into an outgoing stream.

The second conveyors are most efficiently arranged in pairs each ending in a merge of the pair to create one of the outgoing streams that is conveyed by a third conveyor. Each second conveyor includes multiple merges along its length at which it receives mail pieces from different first conveyors, and each of the first conveyors contains diverts whereby mail pieces on that first conveyor can be diverted to a second conveyor of each pair. In a preferred configuration, the pairs of second conveyors are stacked vertically to form a multi-level matrix wall, and vertically spaced third conveyors extend from an exit end of each pair of the matrix wall. A pair of matrix walls are disposed side by side, and each of the first conveyors terminates in a pair of branches that convey mail pieces to each of the two matrix walls, each branch containing multiple diverts to convey mail pieces to second conveyors at different levels of each matrix wall.

According to preferred embodiments, the second conveyors include a plurality of gap control modules operable to speed up or slow down movement of a selected mail piece, thereby adjusting gaps between front and rear ends of a mail piece and respective front and rear ends of mail pieces ahead of and trailing the mail piece acted on by the gap control module. The control system operates the gap control modules in a manner effective to avoid collisions between a merging mail piece entering a merge and mail pieces already present in the outgoing mail stream the merging mail piece is entering.

The control system maintains lists of mail pieces in outgoing streams of mail that will be merged and between mail pieces in an incoming stream that will merge with an outgoing stream. The control system operates the gap control modules based on a release plan calculated using decision rules effective to optimize merging of the mail streams being merged. The decision rules reference and compare speed and position of a leading group of one or more mail pieces on each mail stream to be merged, and are applied hierarchically in a manner that promotes the highest system throughput and minimizes the number of mail pieces that must be rejected (diverted to refeed) due to conflicts between mail pieces attempting to merge into the same outgoing stream.

The first, second and third conveyors are preferably pinch belt conveyors, and each gap control module comprises a segment of pinch belt operable by the control system at a different speed from portions of the second conveyor adjoining the gap control module. In general, a conveyor for purposes of the present invention is a mechanical system that can convey a singulated stream of mail pieces while maintaining gap spacing between mail pieces being conveyed. The merge section includes a plurality of gap control modules operable to speed up or slow down movement of a selected mail piece upstream from a merge, wand the control system operates the gap control modules in a manner as effective as possible to avoid collisions between mail pieces in different streams.

The present invention represents an improvement over the system as described in the '606 system because it is able to accomplish routing without using a conveyor crossover function. This reduces the likelihood of contention between mail pieces and increases the performance by reducing the quantity of mail that must be rejected due to mail that needs to be simultaneously to the same path, so the effective overall throughput of the system is increased and the amount of mail that must be fed again is reduced.

The invention further provides a method of merging a pair of first and second streams of mail pieces being transported on first and second pinch belt conveyors into a single outgoing stream on the second conveyor, wherein at least one of the first and second pinch belt conveyors has a series of spaced gap control modules upstream from a merge at which mail pieces from the first conveyor are merged into the stream transported on the second conveyor. The method includes steps of (a) monitoring the speed and position of each mail piece on the first and second conveyors approaching the merge;

(b) using speed and position data from step (a) to calculate when it is necessary to speed up or slow down a mail piece to avoid collisions between mail pieces at the merge;

(c) speeding up and slowing down one or more selected mail pieces on one or both of the conveyors using gap control modules forming part of the pinch belt conveyors in a manner effective to avoid collisions between mail pieces at the merge. To operate the conveyors at high speed the method also preferably includes steps of:

(d) determining when it is necessary to remove one or more mail pieces from one of the first and second conveyors in order to merge the first and second streams successfully; and (e) diverting the one or more mail pieces which must be removed according to step (d) so that it leaves its conveyor without interrupting the mail stream transported on that conveyor.

These and other aspects of the invention are described further in the detailed description that follows.

BRIEF DESCRIPTION OF THE DRAWINGS

In the accompanying drawings, where like numerals denote like elements and letters (A, B, C, etc.) denote multiples of a component.

DETAILED DESCRIPTION

Figure 1:
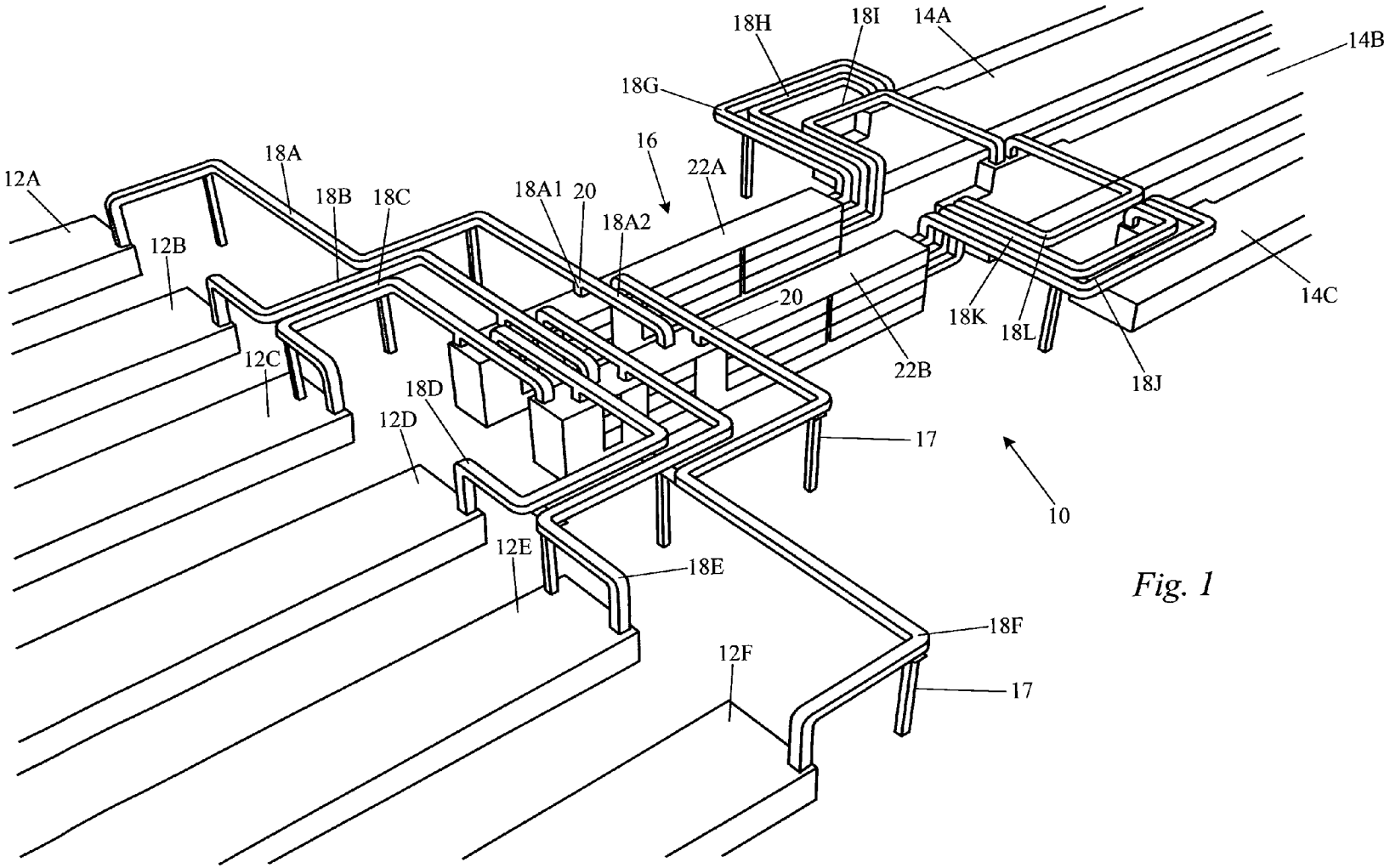
FIG. 1 is a top perspective view of a mail sorting system according to the invention.

Referring to FIGS. 1-4, an embodiment of a sorting system 10 according to the invention interconnects eight input sections 12 to up to four output sections (stacker lines) 14 by means of a switch network 16. This results in a labor savings because in today's environment mail is processed on an AFCS and then taken to an outgoing primary (OGP) sort on a DBCS machine where an operator must feed the mail again. By using a switch network, the labor to queue the mail and feed it on the OGP sort is avoided. The term "switch network" as used herein refers to a set of conveyor pathways that have the ability to switch mail from any one input section 12 to any level of any stacker 14. The preferred switch network according to the present invention uses diverts and merges, but does not use cross-overs or intersections between conveyor paths, which if present limit system performance (slow it down).

Figure 4:
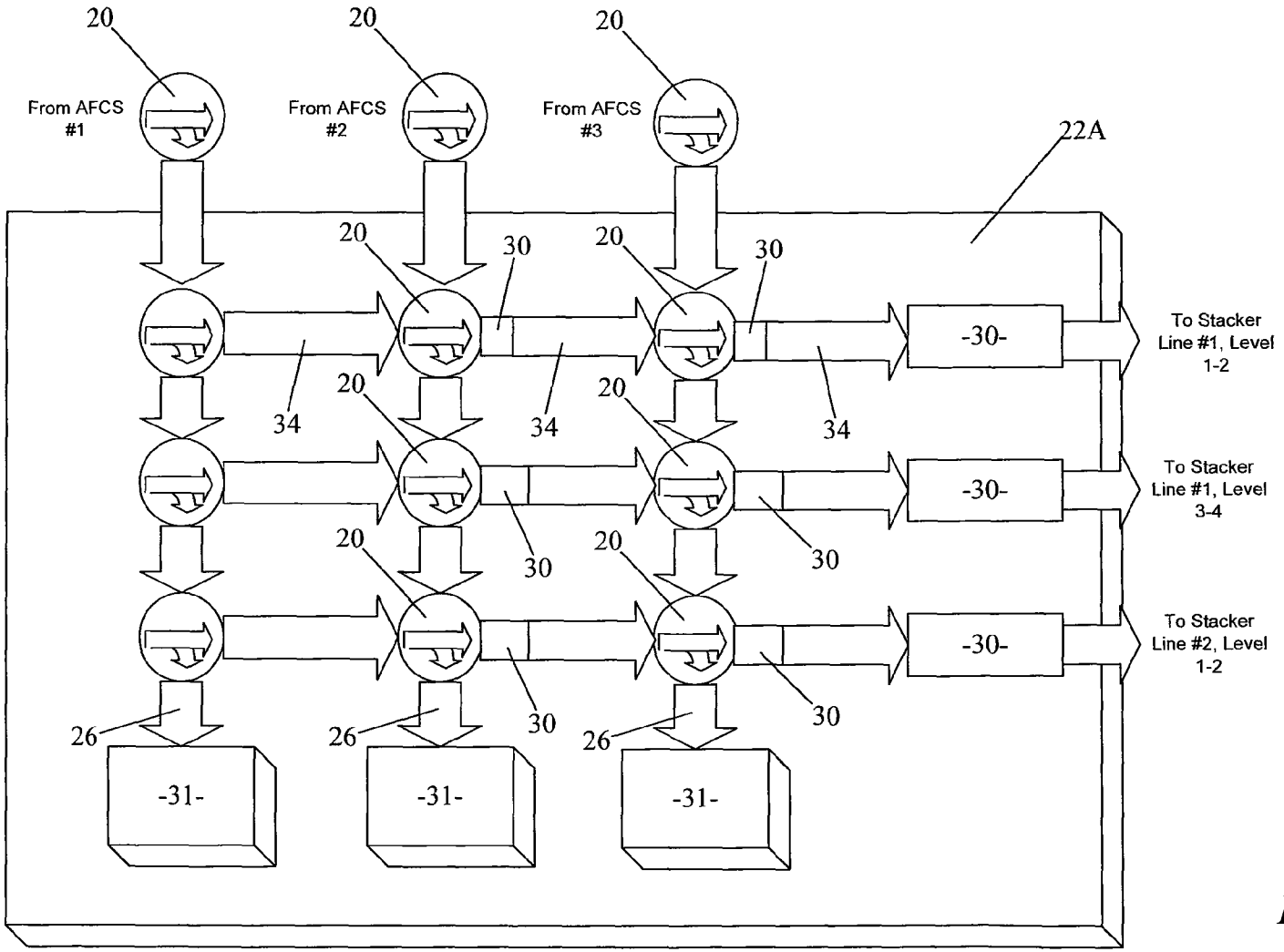
FIG. 4 is a schematic diagram of a matrix wall shown in FIGS. 1-3.

An "input section according to the invention is typically the front end of a postal sorting machine such as an MLOCR or DBCS wherein a singulated stream of mail pieces is created from a series of mail pieces that are automatically fed into a pinch belt conveyor system. It may also comprise an Advanced Facer Canceller System (AFCS) machine with an output conveyor connected to a feeder and scanner or camera so that mail leaving the AFCS machine is scanned for address information in the form of a bar code or OCR of a written address. A takeaway system of the type shown in Barnum et al. U.S. Pat. No. 6,671,577, Dec. 30, 2003, the contents of which are incorporated by reference herein, can be used, except that in Barnum et al. FIG. 4 a single AFCS machine is connected to a single DBCS machine. It is preferred that the feeding and scanning functions are built in to the AFCS machine as shown.

A transport system according to the invention includes the pinch belt conveyor that carries the mail stream past a scanner or camera which reads the destination information and conveys the stream to the stackers. For purposes of the present invention a "stacker" is a series of bins or pockets to which mail pieces are conveyed and stacked inside according to a sort scheme. Divert gates are used to divert a mail piece into the bin or pocket when the mail pieces passes the divert gate on the pinch belt conveyor. It has been common practice for years to create multilevel stackers and modify the transport section to divert a mail piece to one of several levels each comprising a row of pockets with a divert gate.

A basic principle behind the merge concept is that for a multi-level system such as DBCS, each level is capable of running the full throughput of one feeder. The introduction of a highly reliable component, the Channel Gate™ diverter sold by Siemens Energy and Automation, makes this even more practical. This gate is described in U.S. Pat. No. 6,533,271, which is incorporated by reference herein. The Channel Gate diverter is a significant improvement over the previous type of diverter gate because it is more reliable, in particular having a lower jam rate. It is more practical to run mail at a higher throughput. The illustrated embodiment has less moving parts than a typical DBCS machine and there are no single points of failure.

According to the invention a four level stacker line can be operated efficiently at two times the normal operating throughput. Because of the routings that must occur between the input sections 12 (AFCS) and the stacker lines 14, the system of this embodiment is limited to 2 times normal throughput but this still represents a significant improvement. Improvement up to four times normal operating throughput is possible. A machine according to this aspect of the invention has with over 750 pockets available to as many as 8 front ends such as AFCS machines.

Figure 2:
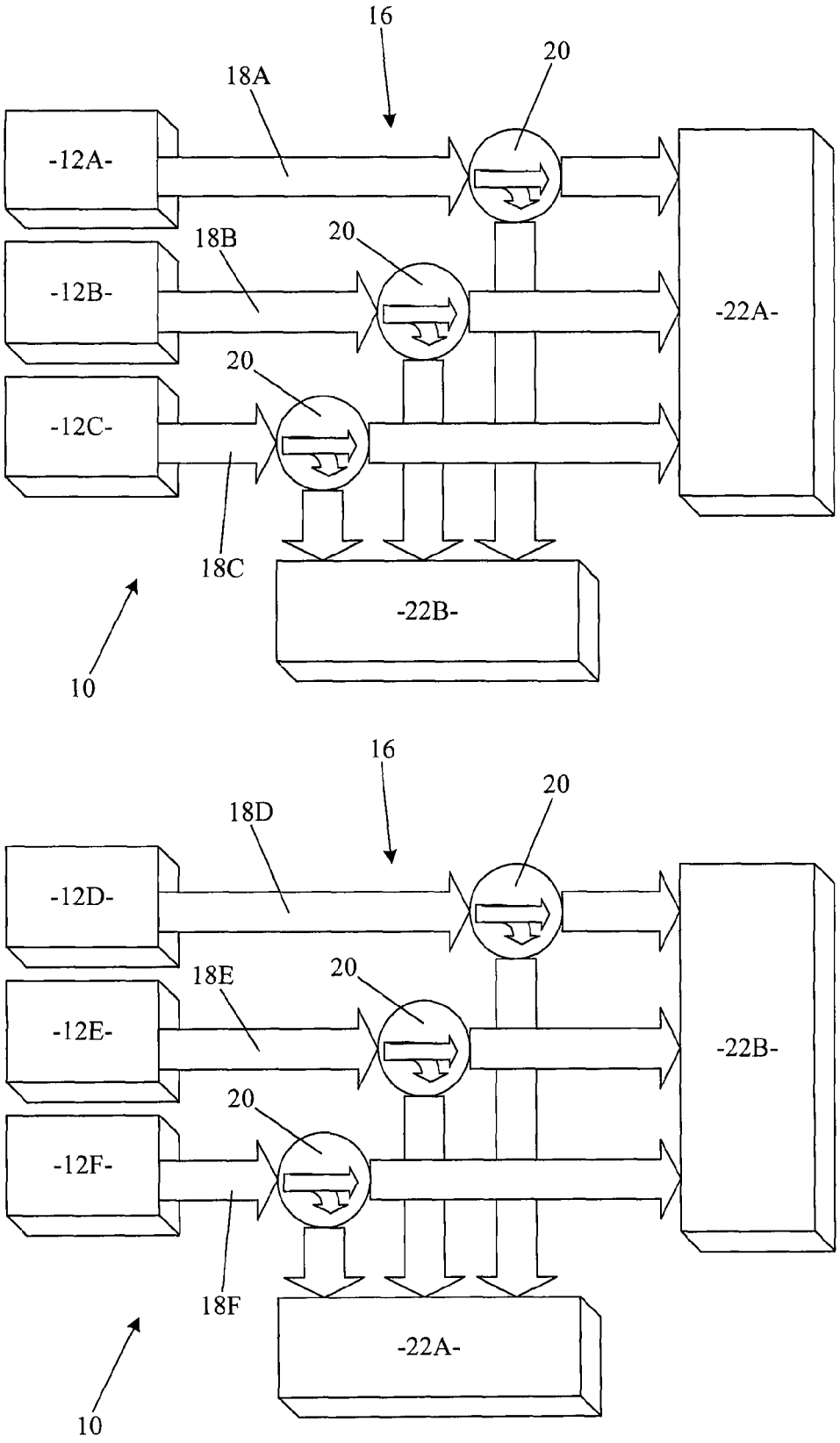
FIG. 2 is a partial schematic diagram of a mail sorting system according to the invention showing connections between the AFCS machines and the matrix walls.
Figure 3:
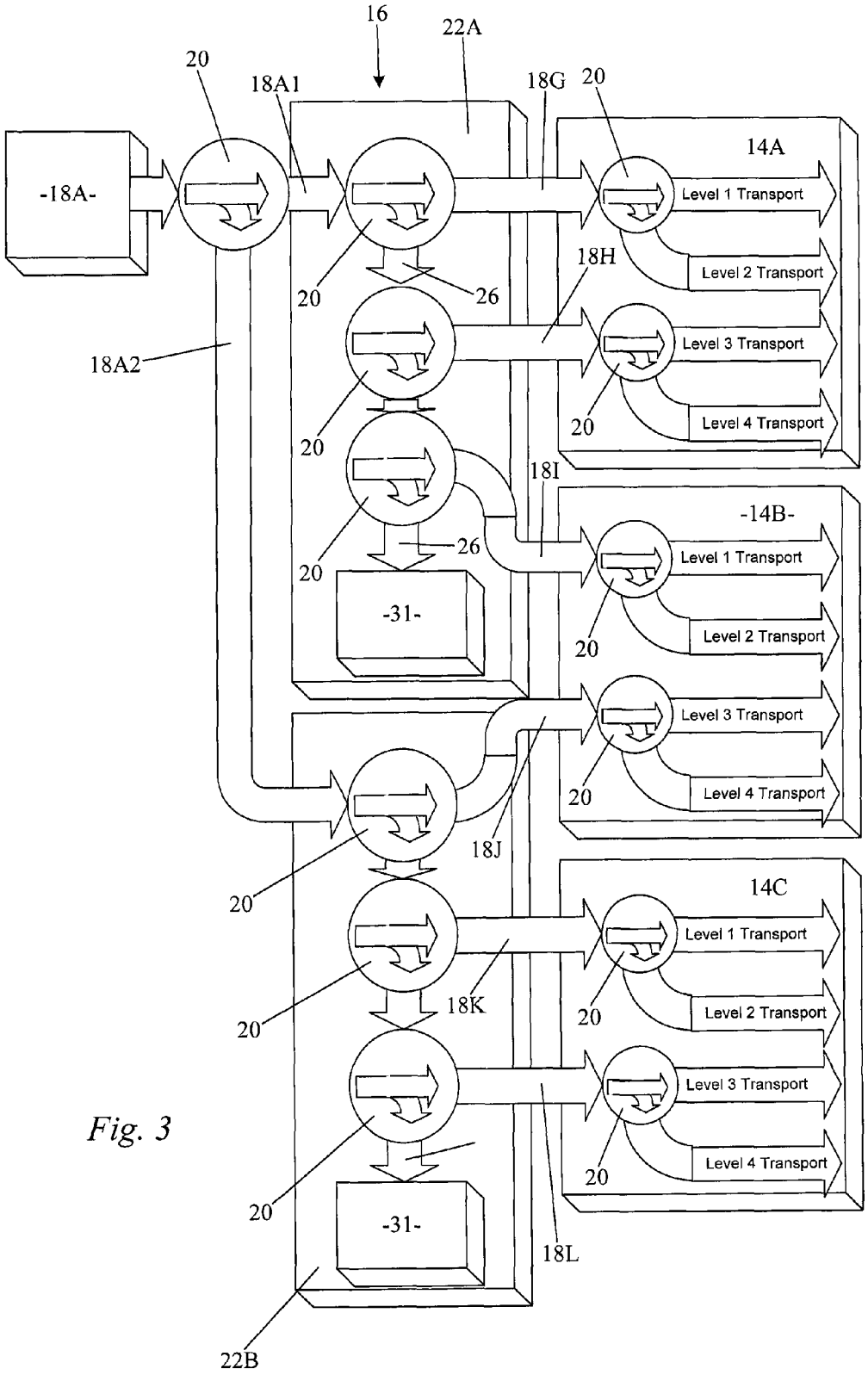
FIG. 3 is a partial schematic diagram of a mail sorting system according to the invention showing connections between the matrix walls and the stacker lines.

FIGS. 1-3 show a system 10 with six AFCS machines 12A-F connected to three DBCS four-level stacker lines 14A-C by means of switch network 16. Switch network 16 includes pinch belt transport conveyors 18A-18F shown mounted on posts 17 as used in most letter automation that carry the mail from each AFCS 12A-12F to a first Channel Gate diverter 20 that routes the letter to a first matrix wall 22A if the final destination is on Stacker line 14A or levels 1-2 of stacker line 14B. Otherwise, the letter goes on to a second matrix wall 22B. In the wall 22A or 22B, the mail is sorted to levels 1-2 or 3-4 that correspond to the appropriate stacker line 14A, B or C. The configuration of pinch belt conveyors 18 makes this possible as explained further below.

A control system determines a destination pocket in the stacker for each mail piece based on a predetermined sort scheme and the destination indicia scanned at the input section 12, and operates the diverts 20 of switch network 16 accordingly. For purposes of the invention, "destination indicia" refers to an ID tag which is associated with stored address information, a bar code which gives the information, or a written address read using OCR. The control system includes one or more computers or logic controllers that are programmed to route the mail as described herein. Some functions of the system do not need to be centrally controlled, such as the operation of the gap control mechanisms (GCMs) discussed below. The control system keeps track of the movement of each mail piece throughout switch network 16. Each divert, merge and gap control module described hereafter is provided with entry photocells that detect the arrival of a mail piece at the component immediately downstream from the photocell. Exit photocells are used as well when necessary to determine the order of mail pieces coming off of a merge or gap control module and monitor the gaps between mail pieces.

Matrix walls 22A, 22B receive mail from each of the six AFCS machines 12A-12F and merge it into three streams that are transported by a second set of pinch belt conveyors 18G-18I (from 22A) and 18J-18L (from 22B). Each of conveyors 18G-L transport the stream of mail from the matrix wall 22A or B to one of stacker lines 14A-14C. Each includes another channel gate 20 which selects the level on the stacker 14 with the destinating pocket for each mail piece as it passes gate 20.

The switch network 16 of the invention is a combination of conveyor paths that transport singulated mail pieces, diverts, gap control modules (GCMs) 28 that manage flow of each stream of mail pieces at key points where mail pieces from different streams come into conflict for position, and merges at which two streams of mail pieces are merged into one. As in Redford et al. U.S. Patent Publication No. 20050247606, each mail piece is scanned at an AFCS 22 to determine a destinating pocket on one level of one of the stackers 14 according to the predetermined sort scheme. For this purpose, the switch network 16 must permit mail from any AFCS 12 can get to any stacker level. This can be done because as the mail is sorted by the matrix wall 22 as described hereafter, gaps between mail pieces are created. However the system cannot put more than the equivalent of one AFCS output in any one stream because the mail path is running at the normal speed and there would not be enough space to have gaps between pieces.

Mail pieces from different AFCS machines 12A-12F that are destined for the same stacker level are merged together by the matrix walls 22A and 22B. In this example, matrix walls 22A, 22B receive the output from all six AFCS machines 12A-12F and recombines the six entry streams into six exit streams sorted by means of diverts and merges. Matrix walls 22 are arranged in rows and columns; in this example, three vertically spaced levels divided into two sides. Vertical stacking of wall levels reduces the size and cost of the system, and reduces its footprint, i.e. floor space it occupies in a postal facility.

Except for the diverts 20 mentioned above that are built into conveyors 18A-F and a final set of diverts 20 to select which level in the stacker a mail piece is sent to built into conveyors 18G-18L, the sorting functions of witch network 16 reside in matrix walls 22A, 22B. Each matrix wall 22 has 2 sides from which mail from conveyors 18A-18F enters. Referring to FIGS. 1-6, each level in a matrix wall 22A, 22B comprises a pair of pinch belt merge conveyors 24 side by side on each level that receive a total of six inputs, one from each AFCS machine 12. Each pair of merge conveyors 24 end in a common output conveyor 18G-18L. Taking the output 18A of the first AFCS machine 12A, it first passes through a first divert 20 wherein it is split into two streams. Each such initial divert 20 occurs above a matrix wall 22 at a T-intersection in FIG. 1. In this example, a part of the stream 18A1 is diverted downwardly into one side of the matrix wall 22A, and the other stream 18A2 continues on horizontally to the other matrix wall 22B as shown.

The downwardly diverted stream 18A1 contains mail pieces that are to be directed to one of the three underlying merge conveyors 24, depending on the destination address for each mail piece. A set of three stacked diverts 20 carries out this decision as to the merge conveyors 24 of the three levels of wall 22A, and any remaining mail pieces are directed to a refeed chute 26. Chute 26 receives mail pieces that could not be sent to the proper level due to a merge conflict, i.e. at the moment of arrival, the mail piece could not be merged into its merge conveyor 24 due to another mail piece arriving on the other side of the merge. The other stream 18A2 sent to the other matrix wall 22B is handled in the same manner, i.e. divided up among three levels on one side of wall 22B. The remaining input conveyors 18B-18F follow the same pattern.

As shown in FIGS. 8-12, each conveyor 24 comprises a series of pinch belt conveyor sections interspersed with Gap Control Modules (GCMs) 28, merge sections 30, and refeed chutes 26 with associated diverters 20. Each GCM 28 is a short section 34A of pinch belt conveyor 34 with an independently controlled servo motor 36. Each GCM 28 can slow or stop a mail piece and can accelerate it to change the gap between it and the mail pieces ahead of it and behind it. Photocells 38 are provided to detect the leading and trailing edges of each mail piece that passes so that the control system knows then a mail piece is entering a GCM 28 and can verify the speed at which the mail piece is moving, if needed.

Figure 5:
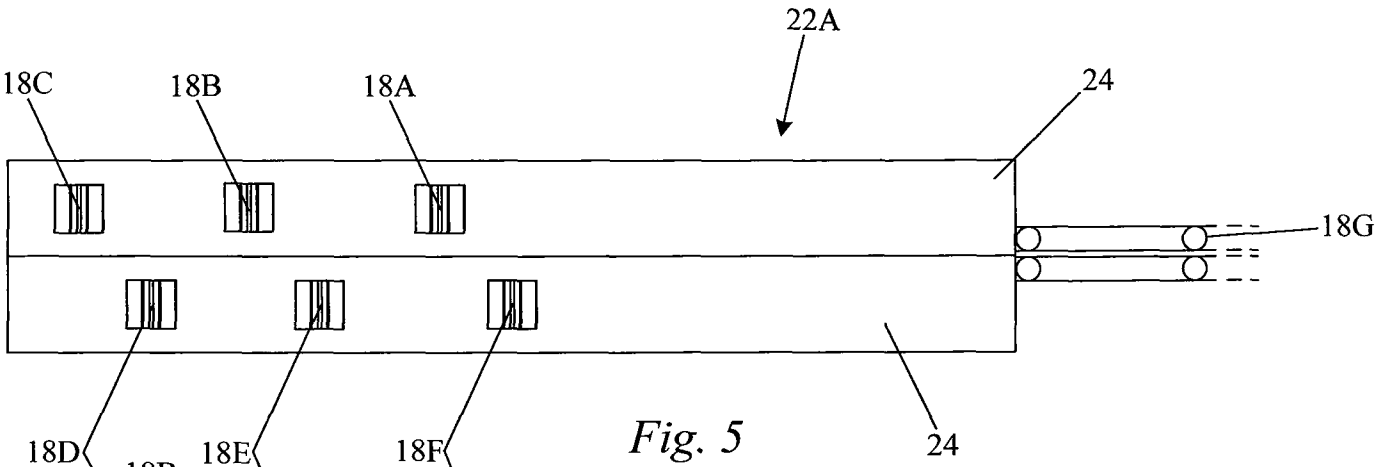
FIG. 5 is a partial top view of a matrix wall shown in FIGS. 1-3.
Figure 6:
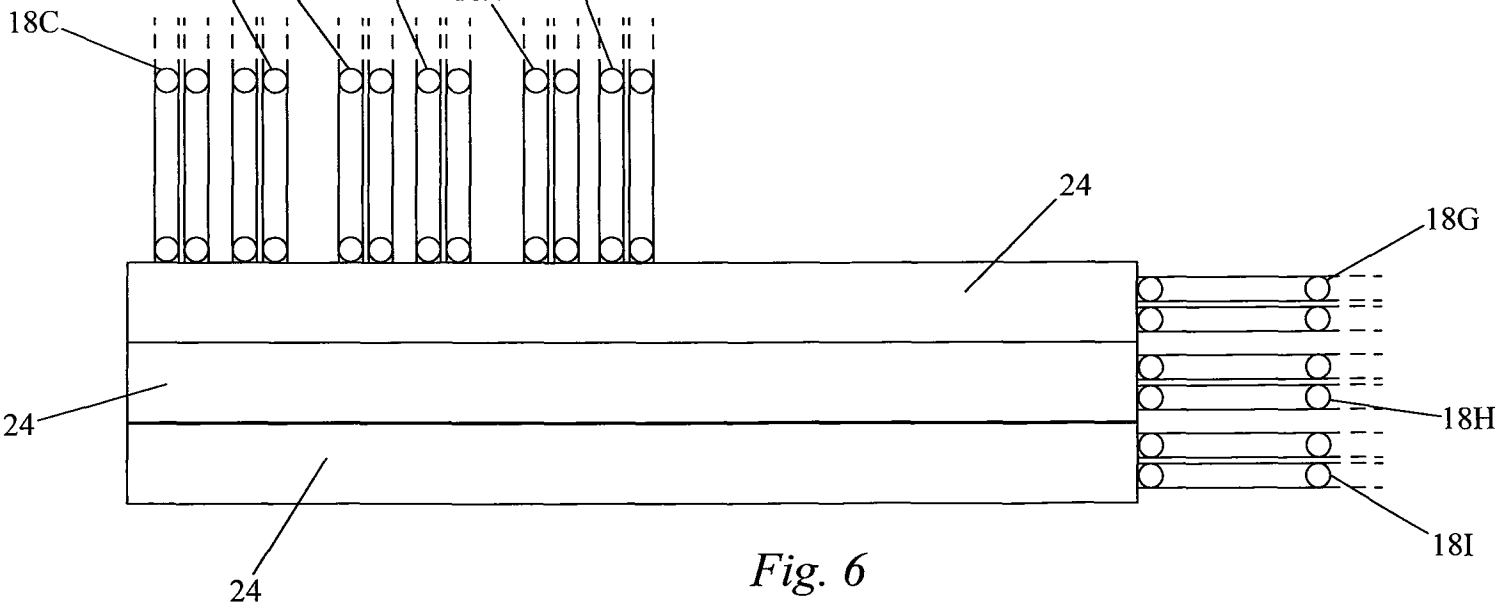
FIG. 6 is a partial side view of the matrix wall of FIG. 5.
Figure 7:
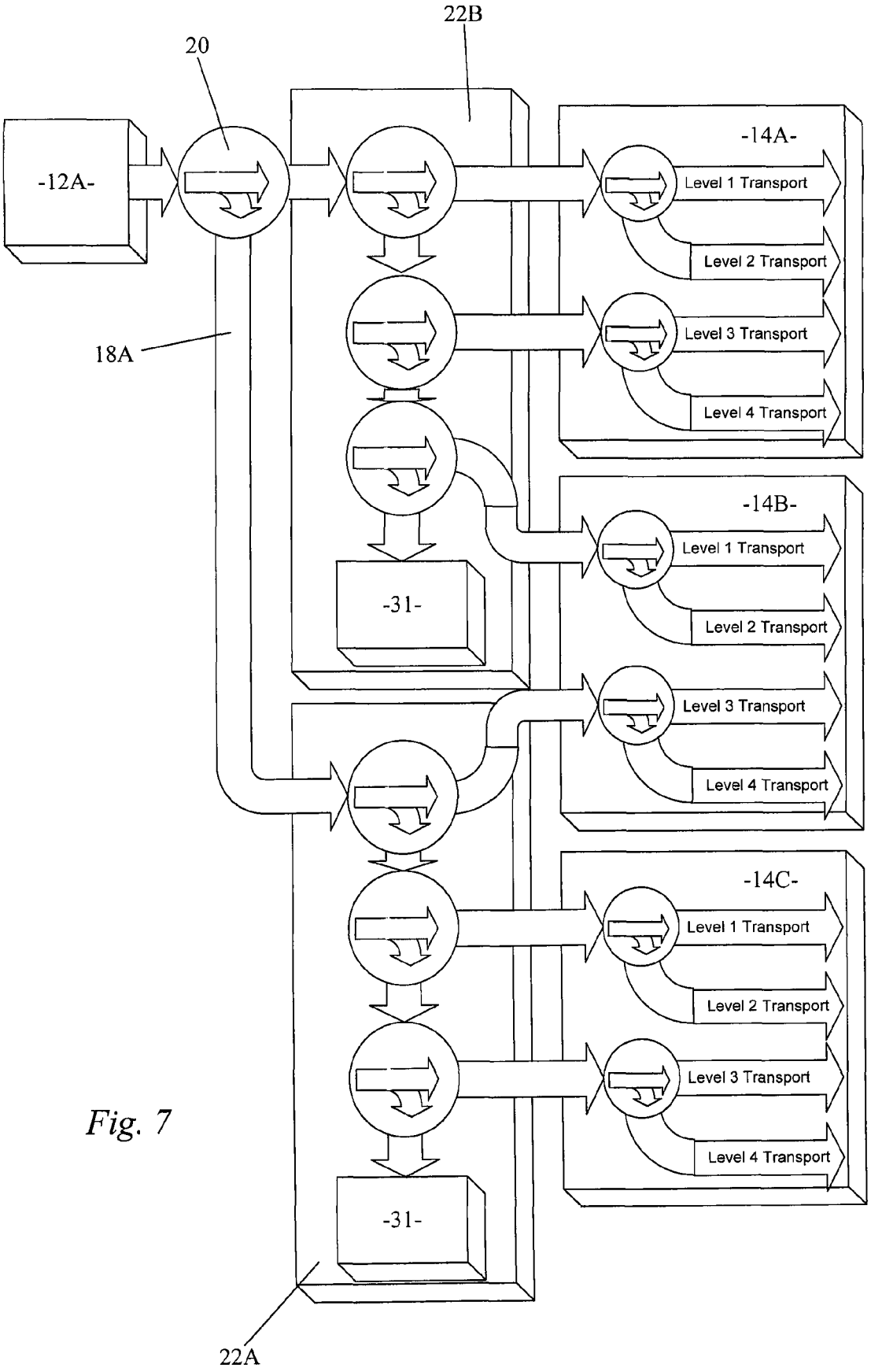
FIG. 7 is a schematic diagram of the matrix walls shown in FIGS. 1-3 connected to the stacker lines.
Figure 8:
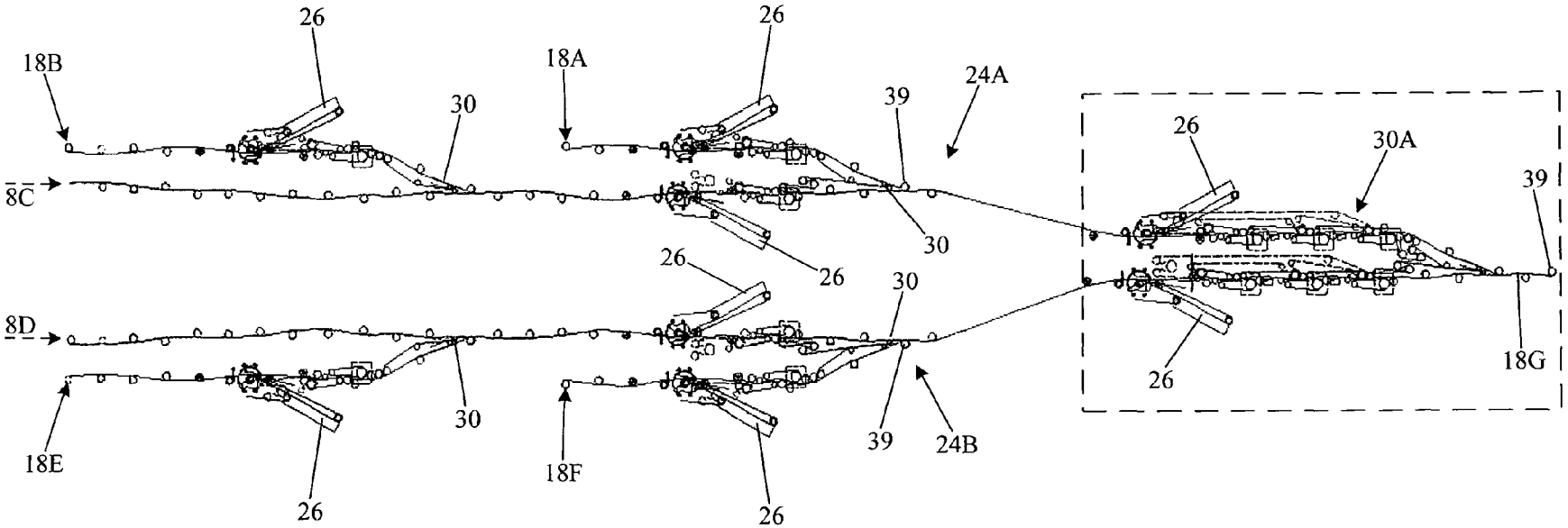
FIG. 8 is a top view of a merge section according to the invention.
Figure 9:
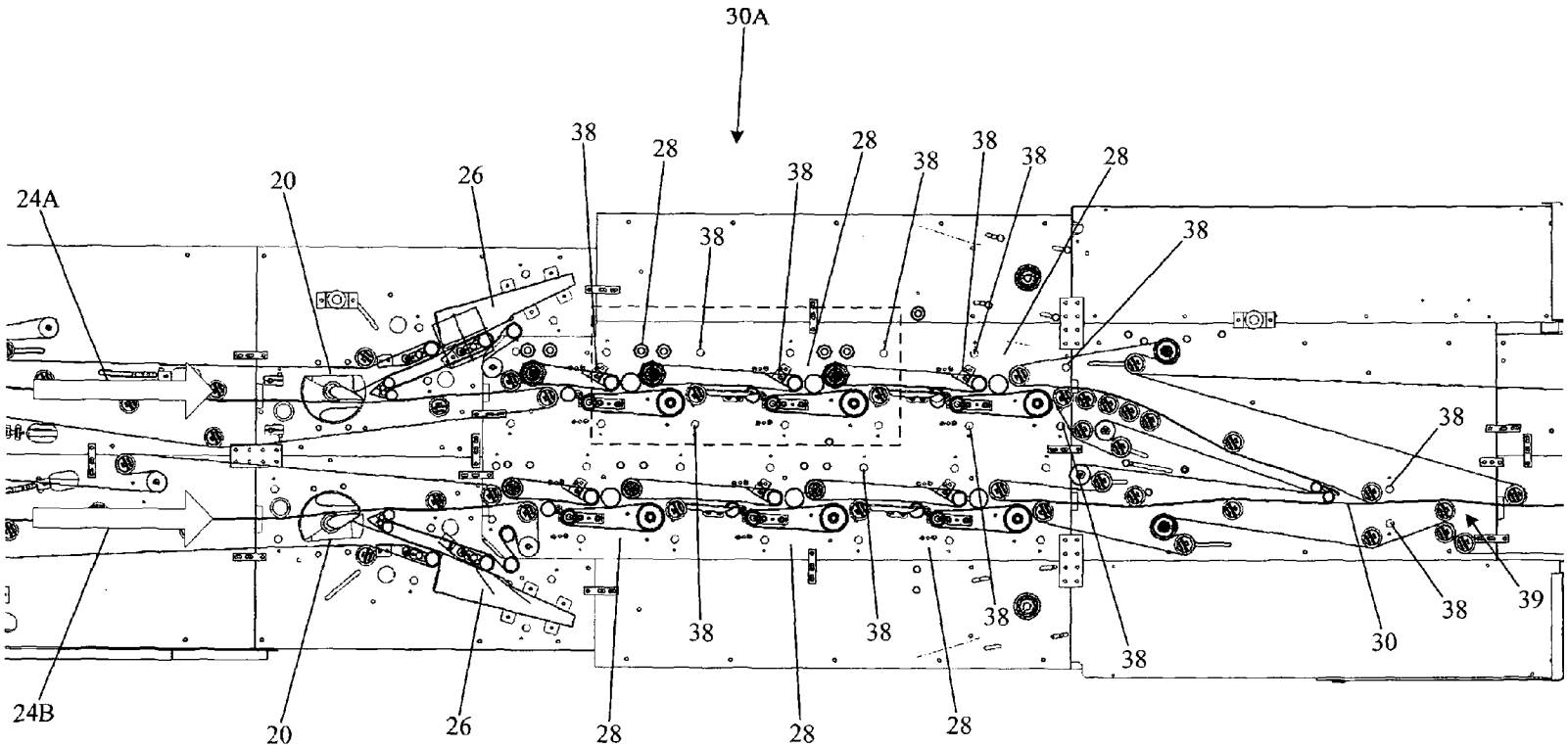
FIG. 9 is a top view of the output end of a merge section according to he invention (dotted box in FIG. 8.
Figure 10:
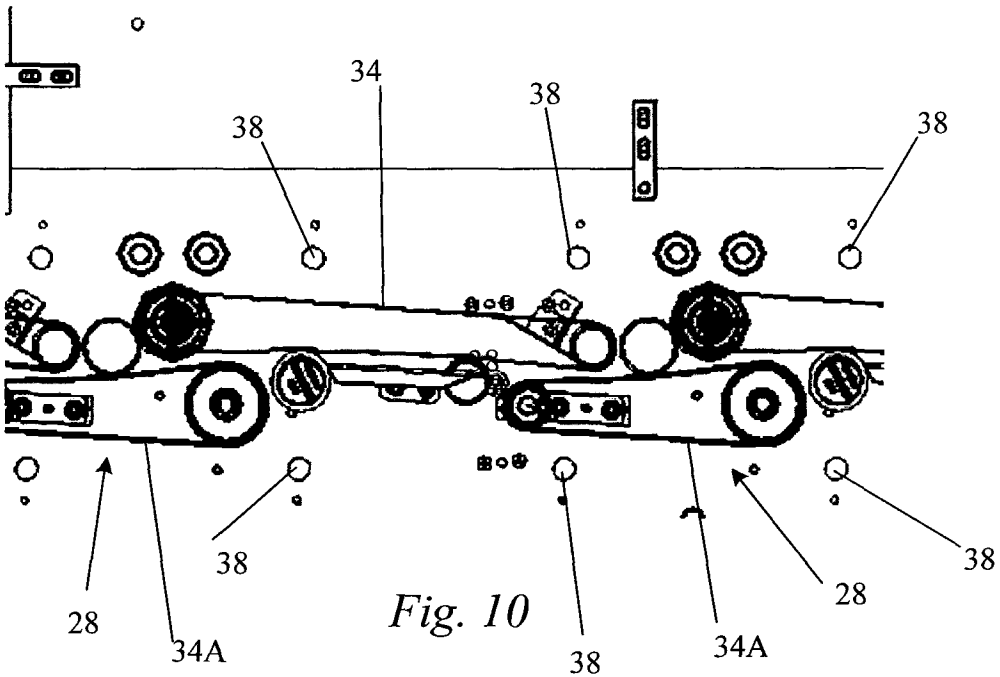
FIG. 10 is an enlarged view of the boxed area in FIG. 9.

Each conveyor 24 receives mail pieces from three AFCS machines 12. Referring to FIGS. 5-6, matrix wall 22A receives mail streams from conveyors 18A-18F at spaced locations along the length of each merge conveyor 24A and 24B. Mail transported on conveyor 18C is directed by conventional mail handling devices to a first infeed conveyor path forming the initial stream of mail on conveyor 24A. Mail transported on conveyor 18B is similarly redirected and must then be merged with the stream from 18C at the first merge section 30 (. Each merge 30 has six GCMs 28, three associated with conveyor 24A(or B) and three with the conveyor 34 which merges the stream from conveyor 18B with the mail stream on conveyor 24 that came from conveyor 18C. GCMs 28 are controlled in a manner that avoids conflicts between merging mail pieces as described hereafter, and when it is not possible to avoid a conflict, a gap is created by ejecting a mail piece through one of output chutes 26.

Figure 11:
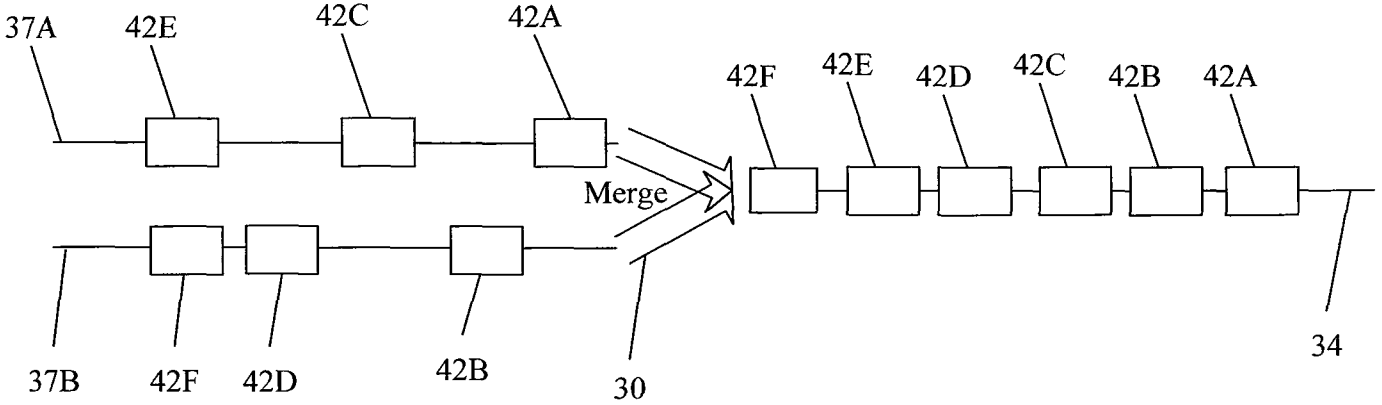
FIG. 11 is a diagram illustrating mail pieces arriving at a merge in the matrix wall.
Figure 12:
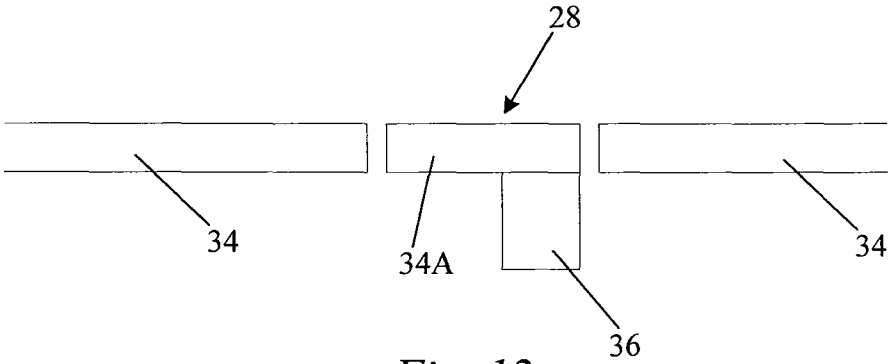
FIG. 12 is a diagram illustrating a gap control module (GCM) according to the invention.

In the example of FIG. 11, a letter 42F was slowed down by the GCMs to merge after letter 42E. In this example there is sufficient space between mail pieces on both of the merging conveyors 24. At some merges 30, GCMs 28 are put in series to allow "buffering" of the mail in this manner. As many as 4 GCMs 28 may be in series on each mail path going into a merge 30. However if the control system determines that operating the available GCMs 28 will not be sufficient to permit two streams to merge successfully, a mail piece upstream is diverted through the refeed chute 26. Depending on the composition of the incoming mail, as much as 1.5% of the incoming mail may be discharged for re-feeding.

Due to the distribution of the mail, i.e. the amount of mail being sent to particular destinations or postal zones, sometimes there is sometimes too much mail bound for one stacker level pair. When this happens, the system diverts some such mail out to refeed chutes 26 to avoid a jam. To reduce the likelihood of this occurring, in the sort scheme, high density destinations are assigned 2 pockets that are not on the same level pair. The system can select which pocket to use to avoid contention during transport. Certain refeed chute(s) 26 can be designated to receive mail pieces to high density destinations, acting as sort destinations like the corresponding pocket of the stacker, while reducing the overall load on the switch network 16 at the same time. However, due to the difficulty of collecting such mail, it is preferred to use chutes 26 for refeed mail only.

The computerized control system uses a program referred to herein as the merge algorithm to determine how each mail piece will be handled as it passes through matrix wall 22A or 22B. The merge algorithm works by analyzing the incoming mail-stream to each conveyor 24, and detecting the leading/trailing edges of individual mail pieces on each lane as soon as they become visible to a photocell 38. With each new mail-piece arrival at the first photocell 38 at the entrance to a merge, a new optimal release plan is re-formulated by the control computer. This 'plan' comprises the desired order of mail-pieces in the output stream, and assigns to each mail-piece a planned adjustment (delay or advance, in mm), as well as a particular GCM 28 to carry out that planned adjustment.

When each mail piece reaches its critical decision point at a divert, the mail-piece is considered "committed" by the control system. From this point if there are no available GCMs 28 to merge the mail piece or if it proves impossible to merge it, it is diverted to the re-feed bin 31 through the associated chute 26. Otherwise the mail piece continues moving on its conveyor 24. When each mail piece reaches its assigned GCM 28 it is advanced, delayed, or maintained at constant speed according to the individual assignment from the plan.

The merge plan is implemented using predetermined zones of analysis and execution. A merge unit 30 has two input lanes 37A, 37B. On arrival, mail pieces are placed into a linked list of the corresponding lane and tracked from there, through the point of commitment at the divert gate, through the execution zone's GCMs 28, on to a combined merge exit point 39 (see FIG. 9). A "list" for purposes of the invention means computer accessible data which the control system can access, such as a table or array stored in memory of a control computer.

Upon arrival of each mail-piece at exit point 39, a new merge release plan is prepared. First, the merge release list is initialized with the list of already committed mail pieces. The algorithm then copies each as yet uncommitted mail-piece into the merge output list in planned release order. The criteria through which the algorithm determines the optimal release order are described below. As it is being placed on the release list, each mail-piece is assigned a displacement adjustment necessary to fall into that order, as well as the appropriate GCM to 28 carry out that adjustment. If there are no available GCMs 28, the mail-piece is designated to be diverted.

When a mail-piece reaches its critical decision point at the re-feed divert gate 35, its current plan assignment is frozen: the mail-piece is now said to be committed. It is placed onto the committed lists of its lane 37, as well as the combined merge output stream list. This committed merge list is used as a starting point in preparing the next release plan. These lists exist in the memory of one or more computers of the control system and are subject to rapid revision as a new mail piece enters and others are diverted through a refeed chute 26 or exit that section of the system to join a new list.

At the time of committing each mail-piece, an additional optional variable-gapping adjustment may be assigned. The purpose of variable gapping is to even out the gap in the merged output mail stream to make it easier for any subsequent merge units downstream from the current one. A burst of mail pieces followed by long gaps results in excessive re-feed losses. Thus, after achieving the best merge strategy possible, the control system(s) for upstream merge units 30 attempts to even out gaps between mail-pieces in the outgoing stream by operating GCMs 28 to apply a variable gapping smoothing. By design, variable gapping should never result in delaying any trailing mail pieces or cause any additional re-feeds. Its action is limited to temporarily slowing or speeding up a mail piece to average the gap before and after that mail-piece. This is done before the mail piece becomes committed.

During each cycle of preparing an updated merge release plan, the merge algorithm as implemented by the control system carries out the following actions: (1) Initialize merge release list using the list of already committed mail-pieces; (2) Initialize unordered mail-piece lists, i.e. a list in current order of appearance of mail pieces incoming to a merge on a conveyor; (3) put all uncommitted mail pieces into appropriate lane's temporary list of mail-pieces yet to be ordered; (4) repeat 1-3 until both temporary lane lists have been exhausted (are empty); and (5) compare the head mail-pieces from opposite lane lists according to certain decision rules described below. A "winning" mail piece is assigned the next available GCM on its lane, placed into the combined merge release order, and removed from temporary lane list.

In comparing the leading mail-pieces from the unassigned lists in opposite lanes, the merge algorithm uses the following rules to decide which mail piece is to yield to the other. Each lane at a given time has a leading mail piece, and the merge algorithm determines which goes first and which goes second. The one going second is said to "yield" to the one going first, which may be termed the "winner". The decision rules are preferably applied in the order discussed hereafter, although other decision rules and combinations are possible.

First the system determines if a lead mail piece can merge as is, without adjustment. If so then it proceeds without adjustment other than one for purposes of gap averaging as described above. In the example shown in FIG. 13A, mail piece A wins (merges first) and mail piece B on the other lane loses (goes second). The resulting gap between A and B after both are merged is determined to be within an acceptable range. In FIGS. 13A-13E, the top line represents a stream of mail being transported on a left pinch belt conveyor 34A transporting the mail from left to right. The bottom line represents a stream of mail being transported on a right side pinch belt conveyor 34B transporting the mail from left to right. The center lane shows the positions A' and B' of the mail pieces after the merge takes place. A the trailing edge portion of each mail pieces is shown shaded. If mail pieces A and B cannot merge without adjustment, the system then determines if one mail-piece advance enough to completely overtake the other. In the example shown in FIG. 13B, A can advance enough to overtake B, hence A wins.

Figure 13A:
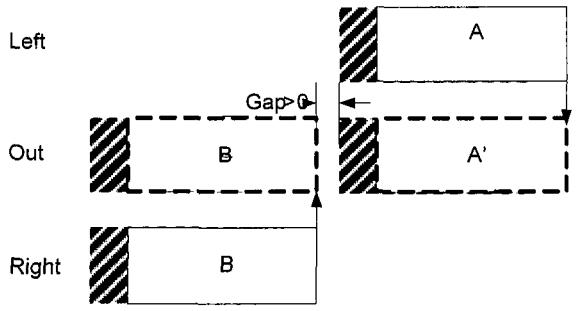
FIGS. 13A-13E are a series of diagrams illustrating examples of decision rules used by the control system.
Figure 13B:
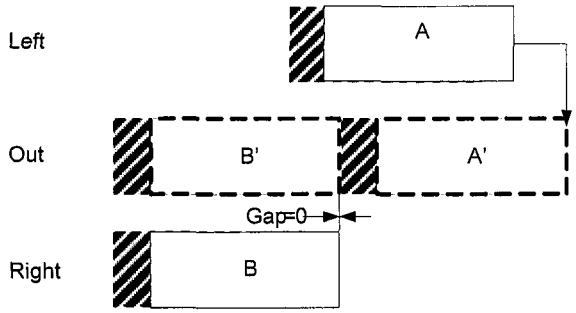
Figure 13C:
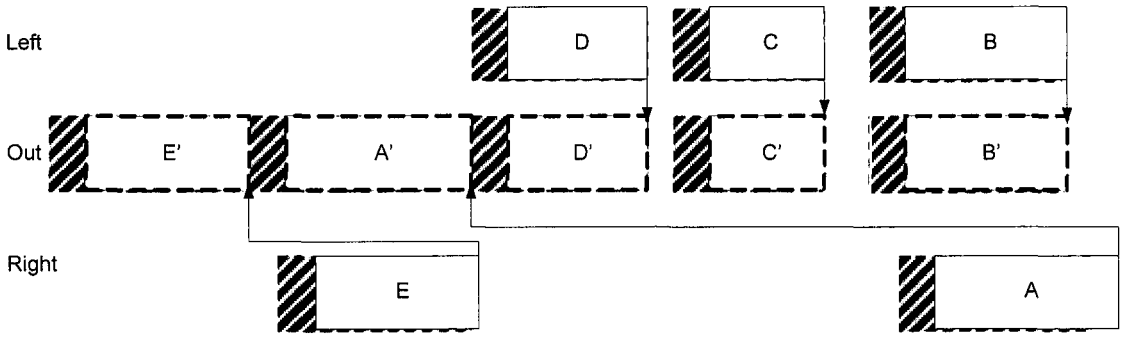

Applying these two rules may not result in a winner. A tie is possible such that A can overtake B, or B can overtake A. The third rule is then: the mail piece that would leave the fewest unused GCMs by yielding wins (goes first). In FIG. 13C, B yielding to A also bumps C & D, needing 3 GCMs (0 unused). On the other hand, A yielding to B also bumps E, needing 2 GCMs leaving 1 unused. The outcome is that A yields to B. The concepr is to choose the mail sequence that uses up the least of the GCM capacity, (i.e. leaves the most excess, unused GCMs). This improves the chance of handling a momentarily discovered future mail piece passing by those GCMs without having to reject it by diverting it to a refeed chute 26.

Figure 13D:
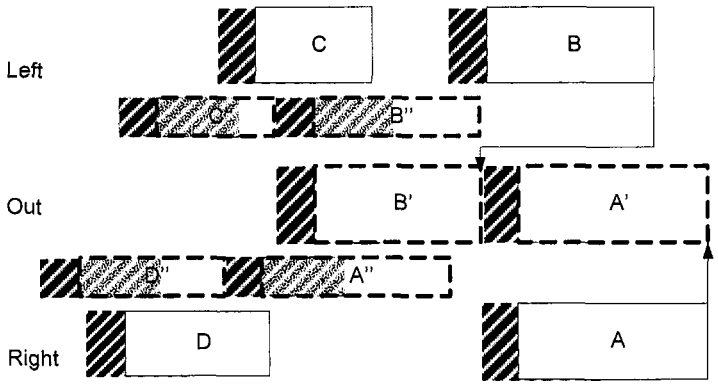

Application of rules 2 and 3 may still result in a tie. As a tie breaker: rule 4 is that the mail piece that leaves the last trailing edge after yielding wins. The "last trailing edge" is the trailing edge of the next mail piece in each lane. As shown in FIG. 13D, B yielding would also bump C to C". A yielding would also bump D to D", its trailing edge is last. A thus wins.

Figure 13E:
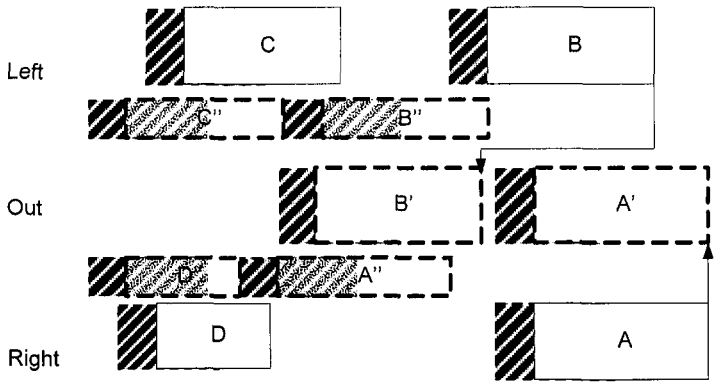

As a fifth rule (2nd tie breaker) the mail piece on the: side with first leading edge wins. In FIG. 13E, trailing edges of C" and D" are identical, but A's leading edge is ahead of B. A therefore wins. If A and B are still tied after application of all of the decision rules, then the system can select one at random to go first, or additional rules based on criteria desirable to smooth operation of the merges could be determined.

As described above, the decision rules reference and compare speed and position of each of a leading group of one or more mail pieces on each mail stream being merged. Preferably the rules are applied hierarchically, that is, if consulting the first rule decides which mail piece goes first, it is unnecessary to consult the other rules, but otherwise the rules are consulted in order of priority as in the foregoing example. The rules are pre-programmed as part of the control system.

Applying the foregoing rules in the order described will provide a faster system speed with a minimized number of refeeds. However, changes and variations of these rules are possible. For example, omission of the third rule (3) will result in more refeeds, and omission of the tie breaker rules (4 and 5) will slow the system down to some degree.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention. A controller for purposes of the invention may be a single control unit that operates the various components or two or more controllers that work together or independently according to the functions described for each section of the system. It is preferred that each merge have its own controller that receives inputs from the photocells on both sides whereby actions implementing the decision rules are rapidly and independently carried out for each merge. Considering the speed at which the conveyors operate, central control of each merge would be more difficult to implement. This and other modifications are within the scope of the invention as expressed in the appended claims.

The invention claimed is:

1. A sorting system for postal mail, comprising:

a plurality of input sections capable of operating in parallel, each including a feeder that takes in mail pieces one at a time and a scanner that scans each mail piece for destination indicia;

a plurality of stackers each comprising at least one row of pockets in which mail is stacked;

a routing section effective to route mail in accordance with a sort scheme from any input section to any pocket of a stacker, which routing section includes:

first conveyors which transport singulated incoming streams of mail pieces away from each of the input sections, a merge section which receives singulated incoming streams of mail from the first conveyors and merges mail pieces from such singulated incoming streams of mail into outgoing streams each containing mail pieces destined for one or more rows of stacker pockets as determined by the sort scheme, the merge section including second conveyors which receive the incoming streams of mail pieces from the first conveyors, refeed chutes positioned in the second conveyors to receive mail pieces which must be removed from the merge section, first diverts in the first conveyors positioned to selectively divert mail pieces to a second conveyor based on the sort scheme, second diverts positioned in the second conveyors to selectively divert mail pieces to a refeed chute, merges positioned in the second conveyors to merge mail pieces into an outgoing stream on a second conveyor, and detectors which detect when a mail piece is in position to be diverted by a divert;

third conveyors which transport streams of outgoing mail pieces from the merge section to the rows of pockets of the stackers; and a control system that determines a destination pocket in the stacker for each mail piece based on the sort scheme and the destination indicia read by the scanners of the input sections, and which operates the first diverts to create the outgoing streams of mail according to the sort scheme while operating the second diverts associated with refeed chutes when the control system determines that a mail piece entering a merge cannot be merged into an outgoing stream, due to a merge conflict with another mail piece wherein the second conveyors are arranged in pairs each ending in a merge of the pair to create one of the outgoing streams that is conveyed by a third conveyor, and each second conveyor includes multiple merges along its length at which it receives mail pieces from different first conveyors, and each of the first conveyors contains diverts whereby mail pieces on that first conveyor can be diverted to a second conveyor of each pair.

2. The system of claim 1, wherein the pairs of second conveyors are stacked vertically to form a multi-level matrix wall, and vertically spaced third conveyors extend from an exit end of each pair of the matrix wall.

3. The system of claim 2, wherein the system contains a pair of matrix walls disposed side by side, and each of the first conveyors terminates in a pair of branches that convey mail pieces to each of the two matrix walls, each branch containing multiple diverts to convey mail pieces to second conveyors at different levels of each matrix wall.

4. The system of claim 1, wherein the second conveyors include a plurality of gap control modules operable to speed up or slow down movement of a selected mail piece thereby adjusting gaps between front and rear ends of a mail piece and respective front and rear ends of mail pieces ahead of and trailing the mail piece acted on by the gap control module, wherein the control system operates the gap control modules to avoid collisions between mail pieces entering a merge.

5. The system of claim 4, wherein the control system maintains lists of mail pieces in streams of mail that will be merged and receives signals from the detectors which enable the control system to track positions of mail pieces in the streams to be merged, and the control system operates the gap control modules based on a release plan calculated using decision rules effective to optimize merging of the mail streams being merged.

6. The system of claim 5, wherein the decision rules reference and compare speed and position of a leading group of one or more mail pieces on each mail stream to be merged, and are applied hierarchically.

7. The system of claim 1, wherein the first, second and third conveyors are pinch belt conveyors.

8. The system of claim 4, wherein the first, second and third conveyors are pinch belt conveyors, and each gap control module comprises a segment of pinch belt driven by a variable speed drive motor and operable by the control system at a different speed from portions of the second conveyor adjoining the gap control module.

9. The system of claim 8, wherein a series of gap control modules are spaced apart on a second conveyor ahead of a merge.

10. The system of claim 1, wherein the input sections comprise AFCS machines.

11. The system of claim 1, wherein each stacker comprises a set of vertically stacked rows of pockets and each stacker is spaced apart from adjacent stackers, wherein a third conveyor supplies mail pieces to each row of each stacker, and the number of input sections is double the number of stackers.

* * * * *